US006334552B1

(12) United States Patent
Bougamont et al.

(10) Patent No.: US 6,334,552 B1
(45) Date of Patent: Jan. 1, 2002

(54) DISPENSER WITH PERIPHERAL DELIVERY MODE

(75) Inventors: Jean-Louis Bougamont, Eu; Christophe Roy, Dieppe, both of (FR)

(73) Assignee: Rexam Sofab (FR)

( * ) Notice: Subject to any disclaimer, the term of this patent is extended or adjusted under 35 U.S.C. 154(b) by 0 days.

(21) Appl. No.: 09/821,458

(22) PCT Filed: Oct. 5, 1999

(86) PCT No.: PCT/FR99/02370

§ 371 Date: Apr. 6, 2001

§ 102(e) Date: Apr. 6, 2001

(87) PCT Pub. No.: WO00/20294

PCT Pub. Date: Apr. 13, 2000

(30) Foreign Application Priority Data

Oct. 7, 1998 (FR) ..... 9812556

(51) Int. Cl.[7] ..... B67D 5/42
(52) U.S. Cl. ..... 222/380; 222/341
(58) Field of Search ..... 222/341, 380, 222/385

(56) References Cited

U.S. PATENT DOCUMENTS 3,502,035 A 3/1970 Fedit et al.
4,757,922 A 7/1988 Landecker
5,282,552 A 2/1994 Ophardt
5,687,877 A 11/1997 Somlen, Jr.
5,871,126 A * 2/1999 Bennett et al. ..... 222/380

FOREIGN PATENT DOCUMENTS

FR 2 517 990 6/1983

* cited by examiner

*Primary Examiner*—Philippe Derakshani
(74) *Attorney, Agent, or Firm*—Bacon & Thomas, PLLC

(57) ABSTRACT

The invention relates to a dispenser for dispensing viscous liquids, which dispenser is designed to be mounted on a container; said dispenser being characterized in that it comprises a bowl (1) whose bottom is provided with an inlet orifice (10) equipped with a valve (11), and whose top is closed off by a piston (2) that is urged back into its high position by a spring (3) and that co-operates with the inside wall of the bowl to define a metering chamber (12), the wall of said chamber including an annular zone, all or part of which is elastically deformable so as to act, under the effect of the pressure generated inside the chamber (12) to release a passageway (P) via which the liquid can be removed, which passageway opens out peripherally to the outside.

15 Claims, 3 Drawing Sheets

DISPENSER WITH PERIPHERAL DELIVERY MODE

Figure 1A:
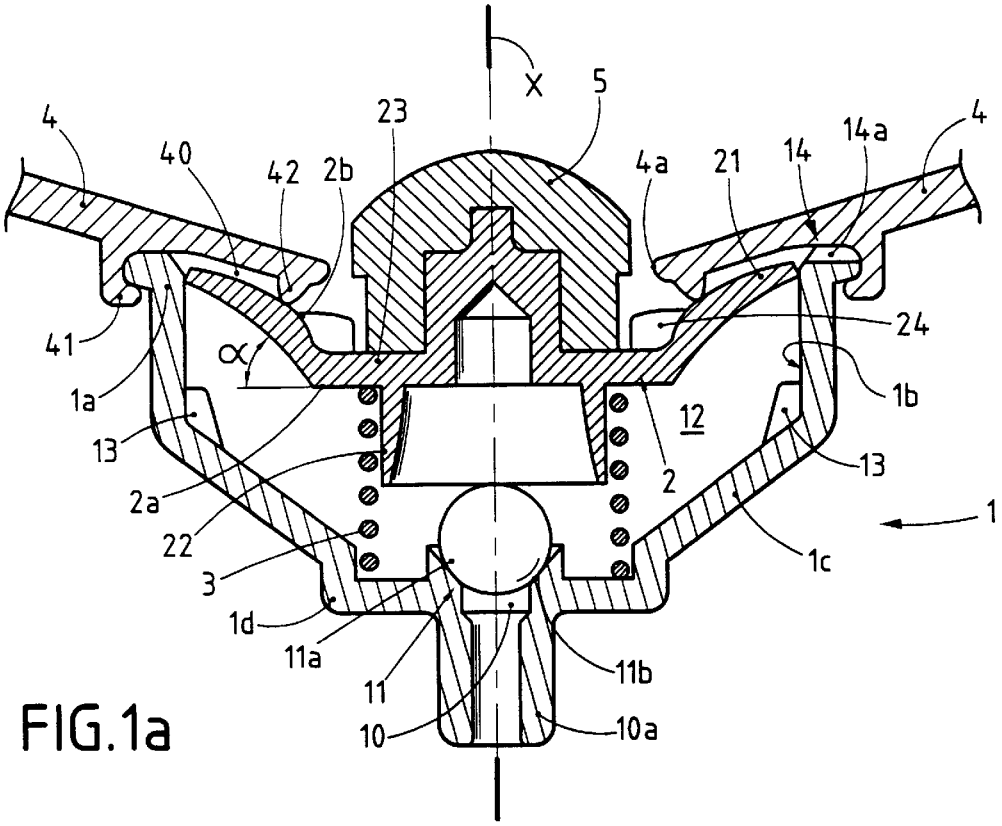

The present invention relates to a dispenser having a peripheral delivery mode, which dispenser is designed to be mounted on a container for liquids having high viscosity, such as gels, creams, pastes, etc.

Dispensers already exist in which a pump is mounted on the neck of a container so as to deliver the liquid via an axial passageway formed, in particular, by a spray tube.

Documents U.S. Pat. No. 3,502,035, FR 2 517 990, and U.S. Pat. No. 5,282,552 discloses dispensers for dispensing liquids, which dispensers are of the type comprising a bowl whose top edge is fixed to a collar for securing it to the neck of a container, the bottom of said bowl being provided with an inlet orifice equipped with a valve, and whose top is closed off by a piston that is urged back into its high position by a spring and that co-operates with the inside wall of the bowl to define a metering chamber.

However, such dispensers are not suitable for certain types of packaging, for which a final delivery mode that is peripheral or at the least lateral rather than axial is desired.

An object of the invention is to solve this technical problem satisfactorily.

The invention achieves this object by means of a dispenser characterized in that the wall of said chamber includes an annular zone, all or part of which is elastically deformable so as to act, under the effect of the pressure generated inside the chamber to release a passageway via which the liquid can be removed, which passageway opens out peripherally to the outside by passing around the inside edge of the collar which is frustoconical and slopes towards the center.

According to an advantageous characteristic, the inside face of said collar is provided with a groove which is defined on its radially-outermost side by a ring and in which the top edge of the neck is engaged and locked.

In a particular embodiment, the inside edge of said collar forms a high abutment for the piston, thereby retaining it in the bowl.

According to yet another characteristic, the outside face of the piston is provided with a central stud forming a pusher.

Preferably, the bowl is provided with ribs extending along the bottom portion of its inside side wall over a height that is sufficient to enable air to escape on priming, by the piston being forced to deform.

The inside face of the piston is provided with a central sleeve firstly guiding the spring coaxially, and secondly acting as an end-of-stroke abutment by abutting against the bottom of the bowl.

In addition, the dispenser of the invention is optionally provided with a vent in the form of a cutout in the top edge of the bowl.

In a first variant embodiment, said elastically-deformable annular zone is provided around the periphery of the piston by being constituted by a flexible lip whose free end abuts in leaktight manner against the inside side wall of the bowl when in the closed position.

In which case, where the outside face of the piston meets said lip, said outside face is provided with stiffener elements.

In a second variant, said elastically-deformable annular zone is situated on the side wall of the neck by being constituted by peripheral thinned portions suitable for being deformed elastically by the rigid edge of the piston.

In which case, the rigid edge of the piston has a side flank provided with a projection serving to come into deforming abutment against the deformable side wall of the bowl.

In another variant, said elastically-deformable zone is situated on the side wall of the bowl, and is constituted by a peripheral portion made of a flexible elastomer material that is optionally different from the rigid material constituting the other portions of the bowl.

In yet another variant, said elastically-deformable annular zone is constituted by a flexible lip firstly carried by the bottom end of a central cylinder secured to the piston and projecting into the metering chamber, and secondly co-operating with a peripheral scraper element fixed to the inside face of the piston.

In this case, starting from the lip, the passageway via which the liquid is removed is constituted firstly by the enclosure defined around the central cylinder by said scraper element and by said lip, and is constituted secondly by a set of vertical ducts provided around the periphery of said cylinder and communicating at their bottom ends with said enclosure and at their top ends with a set of transverse ducts opening out to the outside.

Also in this case, said lip slopes relative to the axis of the dispenser, and abuts against the radially-innermost edge of the scraper element when in the closed position.

The dispenser of the present invention is more particularly designed for viscous liquids for which it offers a delivery mode that is original and pleasing to the eye.

This dispenser has a structure that is simple, and it is therefore easy to make and to assemble.

It can be adapted very easily, depending on the embodiments, to suit both systems of the "atmospheric" type and also systems of the "airless" type.

Figure 1B:
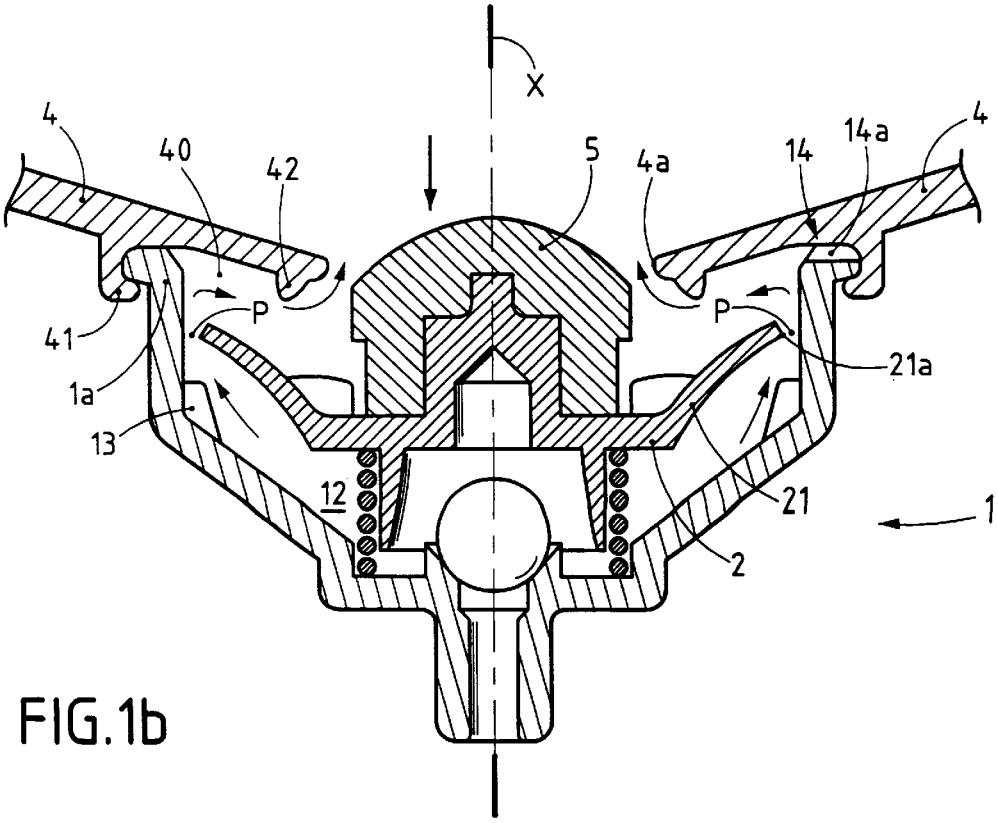
Figure 2A:
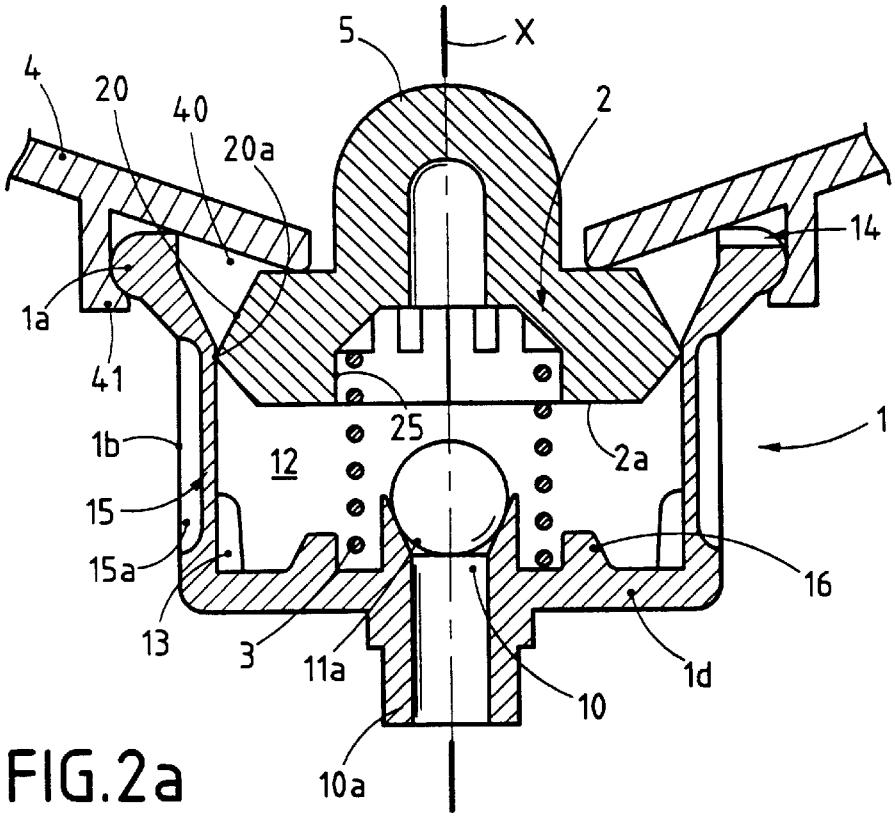
Figure 2B:
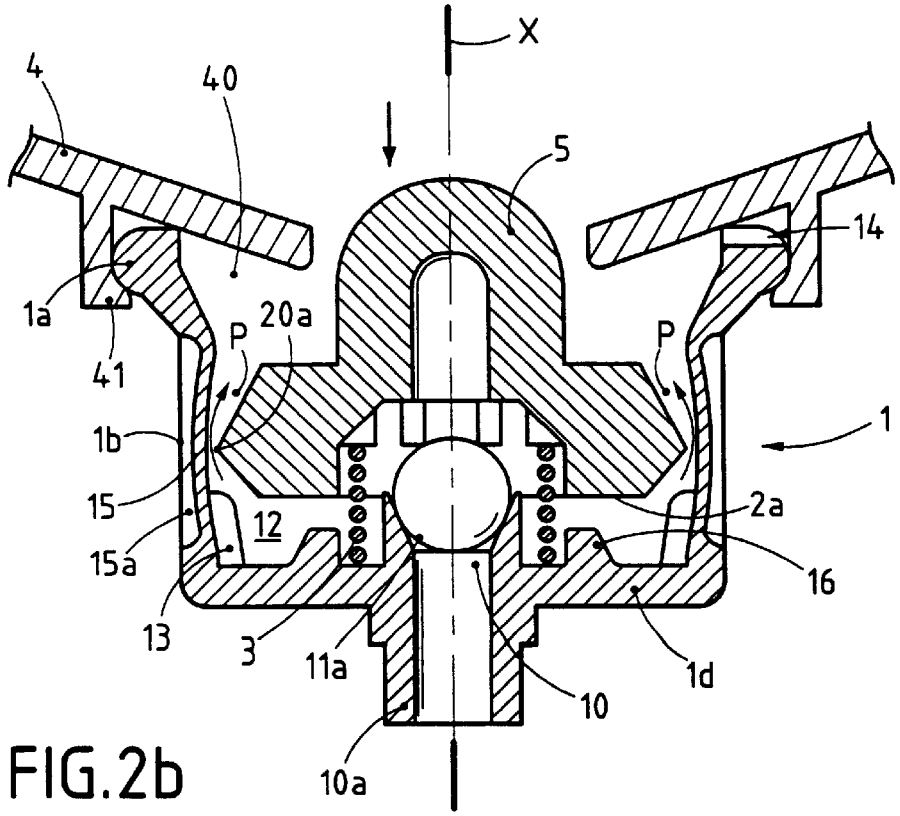
Figure 3A:
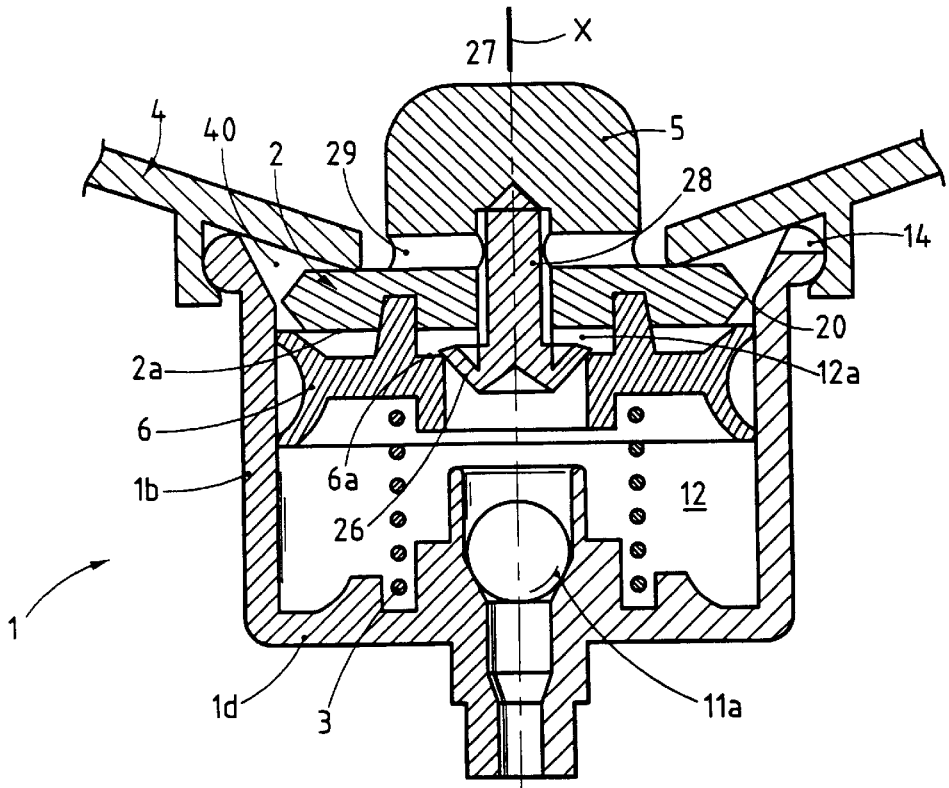
Figure 3B:
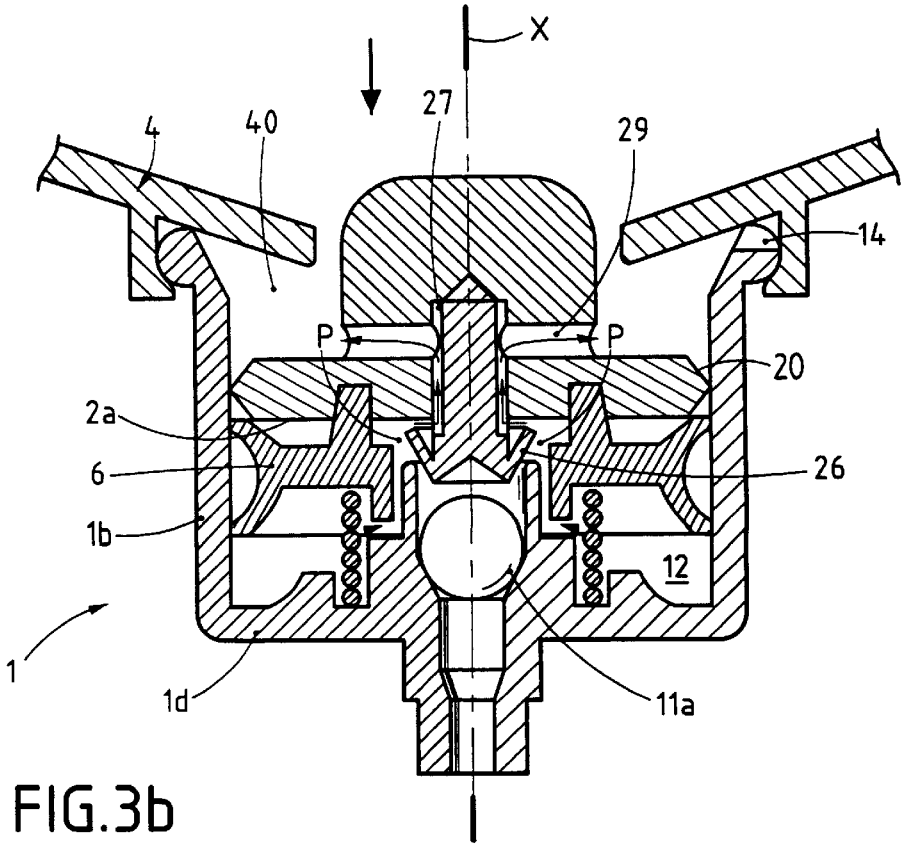

The invention will be better understood on reading the following description accompanied by the drawings, in which:

FIGS. 1*a* and 1*b* are section views of a first embodiment of the dispenser of the invention, shown respectively in the closed position and in the open position;

FIGS. 2*a* and 2*b* are section views of a second embodiment of the dispenser of the invention, shown respectively in the closed position and in the open position; and FIGS. 3*a* and 3*b* are section views of a third embodiment of the dispenser of the invention, shown respectively in the closed position and in the open position.

The dispenser shown in section in FIGS. 1*a* and 1*b* is designed to be mounted on a container (not shown) for containing viscous liquids.

The dispenser includes a bowl 1 whose bottom is provided with an inlet orifice 10 extended downwards, in this example, by a dip tube 10*a* which is designed to project into the container.

The inlet orifice 10 is equipped with a valve 11 formed, in this example by a ball 11*a* resting on a seat 11*b*.

The bowl 1 is closed off at its top by a piston 2 urged back into the high position by a spring 3 and co-operating with the inside wall of the bowl 1 to define a metering chamber 12.

In the invention, provision is made for all or part of an annular zone of the wall of the chamber 12 to be elastically deformable so as to act, under the effect of the piston 2, to release a liquid-removal passageway that opens out peripherally to the outside.

In the embodiment shown in FIGS. 1*a* and 1*b*, the deformable annular zone is provided around the periphery of the piston 2 by being constituted by a flexible lip 21 which, in the closed position, has its free end 21*a* in leaktight abutment against the inside side wall 1*b* of the bowl 1 (see FIG. 1*a*).

In the free state, the peripheral lip 21 slopes upwards at an angle a in the vicinity of 45° relative to the plane of the central portion 23 of the piston 2, the spring 3 abutting against the inside face of said central portion.

Where the central plane portion 23 meets the peripheral lip 21, the outside face 2*b* of the piston 2 is provided with stiffener elements 24.

The top edge 1*a* of the bowl 1 is fixed to a collar 4 for securing the bowl to the neck of the container (not shown).

For this purpose, the inside face of the collar 4 is provided with a groove 40 defined on the radially outermost side by a ring 41 in which the top edge 1*a* of the bowl 1 is engaged and locked.

The collar 4 is preferably frustoconical while sloping towards the center of the dispenser, and its inside edge 4*a* forms a high abutment for the piston 2, thereby retaining it in the bowl 1.

In the embodiment shown in FIGS. 1*a* and 1*b*, the groove 40 is defined on the radially-innermost side by an annular bead 42 carried by the inside edge 4*a* of the collar 4, and abutting against the outside face 2*b* of the piston 2 when in the closed position.

The outside face 2*b* of the piston 2 is provided with a central stud 5 forming a pusher that the user depresses manually to deliver the liquid. The stud is made in one piece with the piston 2, or in the form of a separate piece that is then stuck on or welded on.

When the piston 2 is pushed into the bowl 1 by its outside face 2*b* being depressed, the pressure is transmitted inside the metering chamber 12 to the liquid that occupies said chamber. Since the liquid is incompressible, the flexible lip 21 is deformed preferentially by pivoting upwards, thereby releasing a passageway P via which the liquid can be removed between the free end 21*a* of the lip 21 and the facing inside side wall 1*a* of the bowl 1 (see FIG. 1*b*). After passing through the passageway P, the liquid is directed towards the outside by flowing through the groove 40 and then peripherally around the inside edge 4*a* of the collar 4.

The collar 4 thus forms a dish inside which a small amount of liquid is disposed. When depressing ceases, the lip 21 then returns elastically to its initial sealing position, while the piston 2 rises again under the action of the spring 3, thereby opening the valve 11. A metered dose of liquid is thus sucked up from the container via the inlet orifice 10 and fills the chamber 12. The dispenser is then ready to be used again.

In the embodiment shown in FIGS. 1*a* and 1*b*, the bottom portion of the bowl 1 is constituted by a flat bottom id that is provided with the inlet orifice 10 and that is connected to the side wall 1*b* via a frustoconical flank 1*c*.

The bowl 1 is provided with ribs 13 extending along the bottom portion of its inside side wall 1*a* and over a height sufficient to enable the air to escape on priming by forcing the piston 2 to deform.

The inside face 2*a* of the piston 2 is provided with a central sleeve 22 that firstly guides the spring coaxially with the axis X of the dispenser, and secondly acts as an end-of-stroke abutment by abutting against the bottom 1*d* of the bowl.

The height of the sleeve 22 is thus determined by taking account of the positions and of the height of the ribs 13.

When the piston 2 moves down inside the chamber 12, the ball 11*a* of the valve 11 is received inside the sleeve 22.

The embodiment of the dispenser shown in FIGS. 1*a* and 1*b* is provided with a vent 14 in the form of a cutout 14*a* in the top edge 1*a* of the bowl 1. This cutout 14*a* causes the metering chamber 12 to communicate with the outside during the opening stage.

FIGS. 2*a* and 2*b* show a second embodiment of the dispenser of the invention.

In this embodiment, the elastically-deformable annular zone of the wall of the chamber 12 is situated on the side wall 1*b* of the bowl 1 by being constituted by peripheral thinned portions 15 suitable for being elastically deformed by the rigid edge 20 of the piston 2.

For this purpose, the rigid edge 20 has a side flank provided with an annular projection 20*a* serving to come into deforming abutment against the inside side wall of the bowl 1.

The peripheral thinned portions 15 are, in this example, in the form of cavities or of fluting formed by recessing the outside face of the side wall 1*b*. At the thinned portions 15, the side wall 1*b* is deformed outwards under pressure from the liquid, thereby releasing a passageway P between the projection 20*a* on the piston 2 and the inside face of the thinned portion 15.

In the embodiment shown in FIGS. 2*a* and 2*b*, the sleeve 22 is replaced with a socket 25 defining a central cavity provided in the body of the piston 2.

The bottom face 2*a* of the piston then comes directly into abutment in the bottom 1*d* of the bowl 1, against a crenelated or annular protuberance 16.

In this example, the radially-innermost edge 4*a* of the collar 4 comes into direct contact against the outside face 2*b* of the piston 2 in the high position.

In a variant (not shown), the elastically-deformable annular zone is still situated on the side wall 1*b* of the bowl, but it is constituted by a peripheral portion made of a flexible elastomer material that is optionally different from the rigid material constituted by the bowl. This configuration may be achieved, for example, by means of a two-component injection-molding method.

In the embodiment shown in FIGS. 3*a* and 3*b*, the elastically-deformable annular zone of the wall of the chamber 12 is constituted by a flexible lip 26 carried by the bottom end of a central cylinder 28 secured to the piston 2 and projecting into said chamber.

The lip 26 co-operates with a peripheral scraper element 6 fixed to the inside face 2*a* of the piston 2.

Starting from the chamber 12, and from the lip 26, the passageway P via which the liquid is removed is constituted firstly by the enclosure 12*a* defined around the cylinder 28 by the scraper element 6 and by the lip 26, and constituted secondly by a set of vertical ducts 27 provided around the periphery of the cylinder 28.

At their bottom ends, the ducts 27 communicate with the enclosure 12*a*, and at their top ends, they communicate with a set of transverse ducts 29 opening out to the outside around the periphery of the central stud 5.

The lip 26 slopes relative to the axis X of the dispenser and, when the enclosure 12*a* is in the closed position, said lip bears against the radially-innermost edge 6*a* of the scraper element 6. The pressure generated in the chamber 12 by the piston 2 moving downwards causes the lip 26 to bend upwards, thereby opening the enclosure 12*a*.

In this embodiment, sealing is provided continuously between the side edge 20 of the piston 2 and the side wall 1*b* of the bowl 1.

What is claimed is:

1. A dispenser for dispensing viscous liquids, comprising a bowl whose top edge is fixed to a collar for securing it to a neck of a container, a bottom of said bowl being provided with an inlet orifice equipped with a valve, having a top closed off by a piston that is urged back into a high position by a spring and that co-operates with an inside wall of the bowl to define a metering chamber; wherein a wall of said chamber includes an annular zone, all or part of which is elastically deformable so as to act, under the effect of the pressure generated inside the chamber to release a passageway via which liquid can be removed, which passageway opens out peripherally to the outside of the dispenser by passing around an inside edge of the collar which is frustoconical and slopes towards a center thereof.

2. The dispenser according to claim 1, wherein an inside face of said collar is provided with a groove which is defined on a radially-outermost side by a ring and in which a top edge of the neck is engaged and locked.

3. The dispenser according to claim 1, wherein the inside edge of said collar forms a high abutment for the pisto, thereby retaining it in the bowl.

4. The dispenser according to claim 1, wherein an outside face of the piston is provided with a central stud forming a pusher.

5. The dispenser according to claim 1, wherein the bowl is provided with ribs extending along the bottom portion of its inside side wall over a height that is sufficient to enable air to escape on priming, by the piston being forced to deform.

6. The dispenser according to claim 1, wherein an inside face of the piston is provided with a central sleeve that is arranged firstly to guide the spring coaxially, and secondly acting as an end-of-stroke abutment by abutting against the bottom of the bowl.

7. The dispenser according to claim 1, including a vent in the form of a cutout in the top edge is of the bowl.

8. The dispenser according to claim 1, wherein said elastically-deformable annular zone is provided around the periphery of the piston in the form of a flexible lip whose free end abuts in leaktight manner against an inside side wall of the bowl when in the closed position.

9. The dispenser according to claim 8, wherein an outside face of the piston meets said lip, said outside face is provided with stiffener elements.

10. The dispenser according to claim 1, wherein said elastically-deformable annular zone is situated on a side wall of the neck by being constituted by peripheral thinned portions suitable for being deformed elastically by a rigid edge of the piston.

11. The dispenser according to claim 10, wherein the rigid edge of the piston has a side flank provided with a projection serving to come into deforming abutment against a deformable side wall of the bowl.

12. The dispenser according to claim 1, wherein said elastically-deformable zone is situated on a side wall of the bowl, and is constituted by a peripheral portion made of a flexible elastomer material that is different from the rigid material constituting the other portions of the bowl.

13. The dispenser according to claim 1, wherein said elastically-deformable annular zone is constituted by a flexible lip firstly carried by a bottom end of a central cylinder secured to the piston and projecting into the metering chamber, and secondly co-operating with a peripheral scraper element fixed to an inside face of the piston.

14. The dispenser according to claim 13, wherein starting from the lip, the passageway via which the liquid is removed is constituted firstly by the enclosure defined around the central cylinder by said scraper element and by said lip, and is constituted secondly by a set of vertical ducts provided around the periphery of said cylinder and communicating at their bottom ends with said enclosure and at their top ends with a set of transverse ducts opening out to the outside.

15. The dispenser according to claim 13, wherein said lip has an axis (X) and said lip slopes relative to its axis (X), and abuts against a radially-innermost edge of the scraper element when in the closed position.

* * * * *